US010093517B2

(12) United States Patent
Helenius

(10) Patent No.: US 10,093,517 B2
(45) Date of Patent: Oct. 9, 2018

(54) ROPE TERMINAL ARRANGEMENT AND AN ELEVATOR

(71) Applicant: Juha Helenius, Vantaa (FI)

(72) Inventor: Juha Helenius, Vantaa (FI)

(73) Assignee: Kone Corporation, Helsinki (FI)

( * ) Notice: Subject to any disclaimer, the term of this patent is extended or adjusted under 35 U.S.C. 154(b) by 385 days.

(21) Appl. No.: 15/043,659

(22) Filed: Feb. 15, 2016

(65) Prior Publication Data

US 2016/0272466 A1 Sep. 22, 2016

(30) Foreign Application Priority Data

Mar. 16, 2015 (EP) ..... 15159233

(51) Int. Cl.
*B66B 1/34* (2006.01)
*B66B 7/12* (2006.01)
(Continued)

(52) U.S. Cl.
CPC ..... *B66B 7/1223* (2013.01); *B66B 5/0031* (2013.01); *B66B 5/02* (2013.01); *B66B 7/085* (2013.01)

(58) Field of Classification Search
CPC ..... B66B 7/1223; B66B 5/0031; B66B 5/02; B66B 7/085
(Continued)

(56) References Cited

U.S. PATENT DOCUMENTS 2,685,077 A 9/1954 Lucas
5,149,922 A 9/1992 Kondou
(Continued)

FOREIGN PATENT DOCUMENTS

GB 2267078 A 11/1993

OTHER PUBLICATIONS

European Search Report for European Application No. EP15159233, dated Aug. 31, 2015.

*Primary Examiner* — Anthony Salata
(74) *Attorney, Agent, or Firm* — Harness, Dickey & Pierce, P.L.C.

(57) ABSTRACT

The invention relates to a rope terminal arrangement of an elevator, comprising
compression means comprising two compression members delimiting a rope gap between them, the compression members being arranged to compress a rope end of a belt-shaped rope placed in the rope gap for blocking movement of the rope end in its longitudinal direction relative to the compression members; and
an electrical circuit comprising a contact switch, which is switchable between a first and second state, in particular between open and closed state; and
the contact switch being mounted on one of the rope end and a compression member, and the arrangement, in particular said other of said rope end and a compression member, is provided with actuating means arranged to move together with the other of said rope end and a compression member relative to said one of said rope end and a compression member and to actuate the contact switch to switch its state when the rope end moves in its longitudinal direction relative to the compression member, whereby movement of the rope end in its longitudinal direction relative to the compression member is arranged to cause state change of the electrical circuit; and
a monitoring means arranged to monitor state of the circuit and to trigger one or more actions in response to state change of the circuit. The invention also relates to an elevator implementing said rope terminal arrangement.

16 Claims, 5 Drawing Sheets

(51) Int. Cl.
*B66B 7/08* (2006.01)
*B66B 5/00* (2006.01)
*B66B 5/02* (2006.01)

(58) Field of Classification Search
USPC ..... 187/247, 251, 254, 277, 391, 393, 411, 187/412; 24/115 R, 135 R, 136 L, 136 R
See application file for complete search history.

(56) References Cited

U.S. PATENT DOCUMENTS

| | | | | |
|---|---|---|---|---|
| 6,357,085 | B2 * | 3/2002 | Ericson | B66B 7/085 24/136 R |
| 7,237,656 | B2 * | 7/2007 | Barrett | B66B 1/3484 187/391 |
| 7,410,033 | B2 * | 8/2008 | Veronesi | B66B 7/062 187/391 |
| 7,540,359 | B2 * | 6/2009 | Veronesi | B66B 7/062 187/247 |
| 7,578,035 | B2 * | 8/2009 | Dold | B66B 7/062 24/136 R |
| 7,607,204 | B2 * | 10/2009 | Ach | B66B 7/085 187/411 |
| 8,640,828 | B2 * | 2/2014 | Annen | B66B 7/062 187/251 |
| 8,807,286 | B2 * | 8/2014 | Puranen | B66B 5/0018 187/391 |
| 9,422,134 | B2 * | 8/2016 | Ikonen | B66B 5/0031 |
| 9,790,055 | B2 * | 10/2017 | Kere | B66B 7/085 |
| 2013/0270042 | A1 * | 10/2013 | Henneau | B66B 5/0006 187/251 |
| 2016/0185572 | A1 * | 6/2016 | Lehtinen | B66B 7/085 187/411 |
| 2018/0105391 | A1 * | 4/2018 | Dold | B66B 7/062 |

* cited by examiner

ROPE TERMINAL ARRANGEMENT AND AN ELEVATOR

This application claims priority to European Patent Application No. 15159233.4 filed on Mar. 16, 2015, the entire contents of which are incorporated herein by reference.

FIELD OF THE INVENTION

The invention relates to a rope terminal arrangement for fixing an end of a rope of an elevator to a fixing base as well as to an elevator comprising said rope terminal arrangement. Said elevator is preferably suitable for transporting passengers and/or goods.

BACKGROUND OF THE INVENTION

In elevators, one or more ropes are used as the means by which the elevator car is suspended. Each rope end needs to be fixed to a fixing base, which is typically either the load to be lifted or a stationary structure, depending on the type of suspension chosen for the elevator. The rope ends can be fixed directly to the load, such as the car or counterweight, which is the case when these are to be suspended with 1:1 ratio. Alternatively, the rope ends can be fixed to a stationary structure of the building, which is the case when the car and counterweight are to be suspended with 2:1 ratio, for instance.

Ropes of an elevator typically include one or several load bearing members that are elongated in the longitudinal direction of the rope and each of them forms a continuous structure that continues unbroken throughout the length of the rope. The load bearing members are the members of the rope which are configured to bear together the load exerted on the rope in its longitudinal direction. The load suspended by the rope causes tension on the load bearing member in the longitudinal direction of the rope, which tension can be transmitted by the load bearing member in question all the way from one end of the rope to the other end of the rope. Ropes may further comprise non-bearing components, such as a coating, which cannot transmit tension in the above described way. The coating can be utilized for one or more purposes. For instance, the coating can be used to provide rope with a surface via which the rope can effectively engage frictionally with a drive wheel. The coating can also be used to provide the load bearing members of the rope with protection and/or for positioning these relative to each other.

In prior art, elevator ropes have been fixed to the fixing base with a rope terminal arrangement. Such a rope terminal arrangement has been contemplated, where the rope end is compressed in a gap delimited by two compression members. Thereby, it is subjected to compression in its transverse direction and tensile loading in its longitudinal direction.

Reliability of this kind of configuration relies largely on the grip produced by the compression between the rope surface and the compression member. The rope end should be firmly gripped such that it can't slide out of the compression gap, because this would mean that the suspension of the particular rope would be lost. This kind of rope terminal arrangement has the drawback that a reliable grip is difficult to provide simply. This is the case particularly, when the surface of the rope end is made of material sensitive to deformation under stress, such as elastic polymer materials, like polyurethane, for instance. The surface material is subjected to continuous compression and shear stress, which may cause increasing deformation over time (creep). In long term, the creep phenomenon can lead to rupture of the surface material, slipping and in the worst case unexpected loss of suspension of the particular rope fixed by the rope terminal arrangement.

The rupture lifetime of a coated rope termination, in particular, is difficult to determine on the basis of laboratory tests. In normal operating conditions, the rupture lifetime can be on the order of years, whereas testing can be done up to a few months for practical reasons. Test results should be extrapolated to cover the entire product lifetime, but this is difficult due to the complexity of the creep phenomenon. Because the rupture lifetime is difficult to predict, the long-term safety of the rope termination need to be guaranteed by alternative or additional measures, as a sudden loss of suspension could occur without prior warnings.

BRIEF DESCRIPTION OF THE INVENTION

The object of the invention is to provide a rope terminal arrangement of a rope of an elevator, as well as an elevator, which is improved in terms of its safety. An object is particularly to provide a solution alleviating risks related to firmness of rope gripping. With the solution one or more of the above defined problems of prior art and/or problems discussed or implied elsewhere in the description can be alleviated. With the solution presented, inter alia, it is possible to get a prior warning of the forthcoming dangerous condition endangering reliable rope gripping and avoid further dangerous development by taking appropriate measures for ensuring safety. Advantageous embodiments are presented, inter alia, which are well suitable for safely fixing ropes comprising surface made of elastic material. Advantageous embodiments are presented, inter alia, which are well suitable for safely fixing belt-shaped hoisting ropes. Advantageous embodiments are further presented, inter alia, which are well suitable for hoisting ropes comprising load bearing members made of brittle material.

It is brought forward a new rope terminal arrangement of an elevator, which comprises compression means comprising two compression members delimiting a rope gap between them, the compression members being arranged to compress a rope end of a belt-shaped rope placed in the rope gap for blocking movement of the rope end in its longitudinal direction relative to the compression members; an electrical circuit comprising a contact switch, which is switchable between a first and second state, in particular between open and closed state; the contact switch being mounted on one of the rope end and a compression member, and the arrangement, in particular said other of said rope end and a compression member, is provided with actuating means arranged to move together with the other of said rope end and a compression member relative to said one of said rope end and a compression member and to actuate the contact switch to switch its state when the rope end moves in its longitudinal direction relative to the compression member, whereby movement of the rope end in its longitudinal direction relative to the compression member is arranged to cause state change of the electrical circuit; and a monitoring means arranged to monitor state of the circuit and to trigger one or more actions in response to state change of the circuit. With this configuration, one or more of the above mentioned advantages and/or objectives are achieved. In particular, with this configuration a forthcoming dangerous condition endangering reliable rope gripping can be noticed and reacted to by taking appropriate measures. Preferable further features are introduced in the following, which further features can be combined with the rope terminal arrangement individually or in any combination.

In a preferred embodiment, the elevator comprises an elevator car and said one or more actions include stopping the movement of the elevator car.

In a preferred embodiment, said one or more actions include generating an alarm.

In a preferred embodiment, the elevator comprises an elevator car and said one or more actions include obstructing further runs of the elevator car.

In a preferred embodiment, said other of said rope end and a compression member is provided with said actuating means.

In a preferred embodiment, the contact switch is mounted immovably on said one of the rope end and a compression member, and said actuating means are immovable relative to said other of said rope end and a compression member, preferably mounted immovably thereon or forming an integral part thereof.

In a preferred embodiment, said one of the rope end and a compression member is the rope end, and the other of said rope end and a compression member is a compression member. Then, the contact switch is mounted on the rope end. Then, it its further preferable that the compression member is provided with the actuating means.

In a preferred embodiment, said actuating means is in the form of a detent. The detent is then arranged to move together with said other of said rope end and a compression member relative to said one of said rope end and a compression member and to actuate the contact switch by pressing it to switch its state when the rope end moves in its longitudinal direction relative to the compression member.

In a preferred embodiment, the contact switch is normally closed type and switching the contact open is arranged to open the circuit or the contact being normally open type and switching of the contact closed is arranged to close the circuit In a preferred embodiment, said compression members comprise a first compression member having a first contact face to be pressed against a wide side of the belt-shaped rope; and a second compression member having a second contact face to be pressed against a wide side of the belt-shaped rope; and said compression members are placed such that their contact faces face each other and delimit between them said rope gap.

In a preferred embodiment, the rope has surface made of elastic material. Preferably, the rope comprises an elastic coating forming the outer surface of the rope. Thereby, the surface of the rope is sensitive to deformation under stress. Hence, the above mentioned advantages and/or objectives are of particular relevance with this type of rope to be fixed. Preferably, the elastic coating is or at least comprises polymer material, preferably polyurethane.

In a preferred embodiment, said rope comprises one or more load bearing members embedded in said elastic coating forming the outer surface of the rope and extending parallel to the longitudinal direction of the rope unbroken throughout the length of the rope.

In a preferred embodiment, the rope terminal arrangement comprises a housing on which the compression members are mounted, which housing is fixed to a fixing base, such as to an elevator car or to a counterweight or to a stationary structure of a building.

In a preferred embodiment, the compression members are wedge members, and the terminal arrangement comprises a housing comprising a tapering nest accommodating the wedge members, in particular having a wedge surface for each compression member, and the compression members are movable relative to each other such that the gap is narrowed by wedging of the compression members in the tapering nest, in particular against the wedge surfaces of the housing when moved along the wedge surface of the housing towards the narrower end of the tapering nest.

In a preferred embodiment, said one or more load bearing members is/are made of composite material comprising reinforcing fibers embedded in polymer matrix, said reinforcing fibers preferably being carbon fibers.

In a preferred embodiment, the rope terminal arrangement comprises compression means as defined at opposite rope ends of the same rope, blocking movement of the rope end in its longitudinal direction relative to the compression members, and the circuit comprises two of said contact switches, one of the two contact switches and an actuating means at each of the opposite rope ends of the same rope cooperating as defined, whereby at both ends of the rope movement of the rope end in its longitudinal direction relative to the compression member is arranged to cause state change of the electrical circuit; and the rope comprises load bearing members extending in longitudinal direction of the rope unbroken throughout its length, which load bearing members are made of electrically conductive material, preferably of electrically conductive composite material, the composite material preferably comprising electrically conducting reinforcing fibers embedded in polymer matrix, said reinforcing fibers preferably being carbon fibers, and the one or more of the load bearing members form part of the circuit, and the monitoring means is arranged to monitor state of the circuit and to trigger one or more actions in response to state change of the circuit. Thus, the switches located at opposite rope ends can form part of the same circuit without a separate long wiring connecting them.

In a preferred embodiment, the contact faces of the compression members are arranged to be in contact with and apply compression on substantially the whole width of the rope end.

In a preferred embodiment, the contact faces are straight as viewed in longitudinal direction of the rope. Likewise, the rope (section) placed between them is also straight, i.e. not bent into an arc. Thus, the rope terminal arrangement is well suitable for a hoisting rope that is rigid, and needs to be fixed by a rope terminal arrangement without bending. Thus, it is particularly well suitable for a rope where the load bearing member(s) is/are made of composite material, such as defined above. Composite material of this kind is typically rigid in all directions and thereby also difficult to bend. Rigid ropes being difficult to bend without fracturing them, they cannot be fixed with means requiring sharp bends.

In a preferred embodiment, the reinforcing fibers of each load bearing member are substantially evenly distributed in the polymer matrix of the load bearing member in question. Furthermore, preferably, over 50% of the cross-sectional square area of the load bearing member consists of said reinforcing fibers. Thereby, a high tensile stiffness can be facilitated. Preferably, the load bearing members cover together over proportion 50% of the cross-section of the rope.

In a preferred embodiment, the module of elasticity E of the polymer matrix is over 2 GPa, most preferably over 2.5 GPa, yet more preferably in the range 2.5-10 GPa, most preferably of all in the range 2.5-3.5 GPa.

In a preferred embodiment, substantially all the reinforcing fibers of each load bearing member are parallel with the longitudinal direction of the load bearing member. Thereby the fibers are also parallel with the longitudinal direction of the rope as each load bearing member is oriented parallel with the longitudinal direction of the rope. This facilitates further the longitudinal stiffness of the rope. In this context the disclosed rope terminal arrangement is particularly advantageous, because it does necessitate sharp bending of the rope.

In a preferred embodiment, the rope is arranged to suspend one or more loads of the elevator, such as an elevator car or an elevator car and a counterweight.

In a preferred embodiment, the width/thickness ratio of the rope is more than two, preferably more than 4.

In a preferred embodiment, the rope comprises a plurality of said load bearing members spaced apart in width direction of the rope the coating extending between load bearing members next to each other.

It is also brought forward a new elevator, which comprises at least one rope terminal arrangement as described anywhere above or elsewhere in the application fixing at least one end of a rope of the elevator immovably to a fixing base. Preferably, the rope is arranged to suspend at least the elevator car.

Preferably, the elevator comprises a hoistway; one or more elevator units vertically movable in the hoistway, including at least an elevator car; one or more ropes, each rope being connected with said one or more elevator units and having two ends, each end being fixed immovably to a fixing base, said fixing base being one of the elevator units or a stationary structure of the building wherein the elevator is installed; and one or both of said ends is fixed immovably to its fixing base with a rope terminal arrangement as described anywhere above or elsewhere in the application. Preferably, the rope is arranged to suspend one or more of said elevator units, including at least an elevator car.

The elevator is preferably such that the car thereof is arranged to serve two or more landings. The elevator preferably comprises an elevator control unit controlling movement of the car in response to calls from landing(s) and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
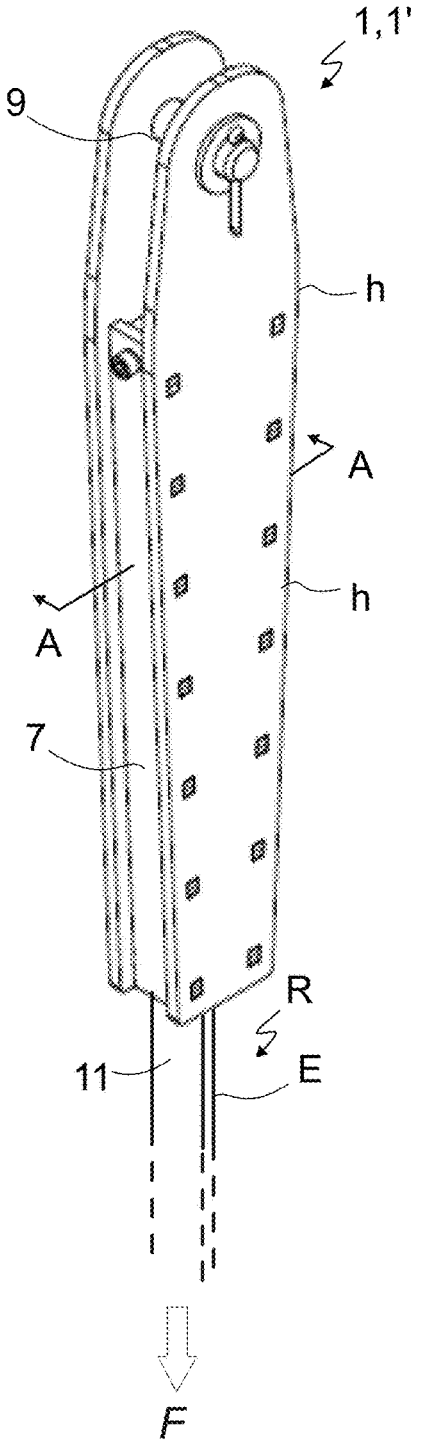
FIG. 1 illustrates an embodiment of a rope terminal arrangement of an elevator
Figure 2:
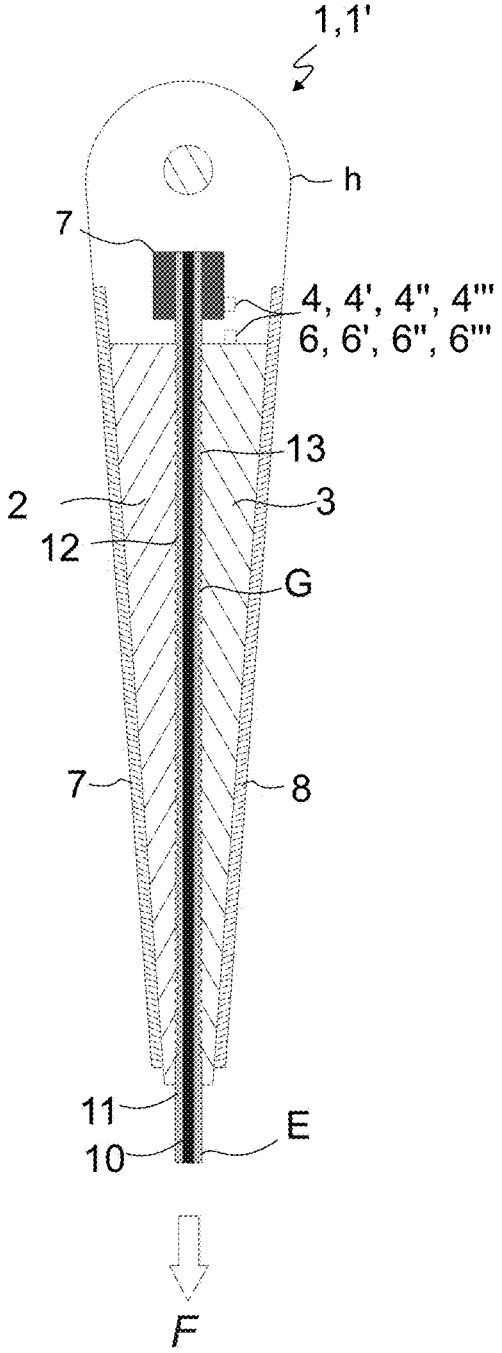
FIG. 2 illustrates cross section A-A of FIG. 1.

FIG. 1 illustrates an embodiment of a rope terminal arrangement 1,1' of an elevator. FIG. 2 illustrates a cross section A-A of the rope terminal arrangement 1,1' of FIG. 1. The rope terminal arrangement 1,1' comprises compression means 2, 3. The compression means comprise comprising two compression members 2,3 delimiting a rope gap G between them, and they are arranged to compress a rope end E of a belt-shaped rope R placed in the rope gap G so as to block movement of the rope end E in its longitudinal direction relative to the compression members 2,3. The rope R is under tension and fixed to a fixing base with said rope terminal arrangement 1,1'. Said compression members 2,3 are movable relative to each other such that the gap G is narrowed. Thereby the contact faces 12,13 of the compression members 2,3 are moveable towards each other so as to compress the rope R placed in the gap G. The compression members 2,3 are such that they comprise a first compression member 2 having a first contact face 12 compressed against a first wide side of the end E of a belt-shaped rope R, and a second compression member 3 having a second contact face 13 pressed against the second wide side of the end E of the belt-shaped rope R, the first and second contact faces of said compression members 2,3 facing each other. In the preferred embodiment shown, the rope R comprises an elastic coating 11 forming the outer surface of the rope R. The contact faces 12,13 of the compression members 2,3 press against the wide sides of the belt-shaped rope R, which are opposite sides of the rope R, thereby pressing against the elastic coating 11. The rope R being belt-shaped it has opposite wide sides which can be compressed by the compression means 2, 3 with large contact area. Large contact area is preferable particularly as thus firm gripping is possible gently. Thereby, the rope terminal arrangement 1,1' can be made suitable for ropes of material which is sensitive to breaking or rupture, such as ropes having surface material and/or load bearing members of the sensitive kind. This is the case particularly when the rope has an elastic coating 11 and/or load bearing members 10 made of brittle material such as composite material specified elsewhere in the application.

The a rope terminal arrangement 1,1' further comprises a contact switch 4, 4', 4", 4", the contact switch 4, 4', 4", 4'" forming part of an electrical circuit c and being switchable between a first and second state, in particular between open state and closed state. The contact switch 4, 4', 4", 4'" is preferably such that in the open state the switch breaks the circuit and in the closed state closes the circuit. The contact switch 4, 4', 4", 4'" may be of a normally closed type (N.C.) whereby switching the contact switch 4, 4', 4", 4'" open is arranged to break the circuit c, or of normally open (N.O.) type whereby switching of the contact switch 4, 4', 4", 4" closed is arranged to close the circuit c. The rope terminal arrangement 1,1' further comprises a monitoring means 5 arranged to monitor state of the circuit c and to trigger one or more actions in response to state change of the circuit. Preferred details of the monitoring means 5 and the circuit c are further discussed with reference to FIGS. 7 and 8. The contact switch 4, 4', 4", 4'" is mounted on one of the rope end E and a compression member 3, and the arrangement, in particular said other of said rope end E and a compression member 3, is provided with actuating means 6, 6', 6", 6'" arranged to move together with said other of said rope end and a compression member 3 relative to said one of said rope end E and a compression member 3 and to actuate the contact switch 4, 4', 4", 4'" to switch its state when the rope end E moves in its longitudinal direction relative to the compression member 3. Thereby movement of the rope end E in its longitudinal direction relative to the compression member 3 is arranged to cause state change of the electrical circuit c. Given that the monitoring means 5 are arranged to trigger one or more actions in response to state change of the circuit c, said movement of the rope end E in its longitudinal direction relative to the compression member 3 causes triggering of said one or more actions. Thereby, said movement gives a prior warning of the forthcoming dangerous condition endangering reliable rope gripping and it is reacted to by appropriate actions. With the movement of the rope end E in its longitudinal direction relative to the compression member 3 it is meant in particular movement directed outwards from the gap G towards the tensioned side. This kind of movement is meant to be blocked with the rope terminal arrangement, however the rope end E is pulled by force F outwards from the gap G towards the tensioned side because of the tension under which the rope R is. This tension is produced in the rope R at least by the load suspended by the rope R but often also partly by the weight of the rope itself.

Preferably, said actions include stopping the movement of the elevator car and/or generating an alarm. Said generating an alarm can comprise sending an alarm signal to a user interface such as one of a service center. Said stopping the movement of the elevator car is preferably, but not necessarily, arranged to be triggered by breaking the safety circuit of the elevator, breaking of which safety circuit is arranged to cut supply of electricity to a holding means for holding a machine brake of the elevator open (i.e. in a non-braking state) and/or to cut supply of electricity to the motor for moving the elevator car.

Figure 3:
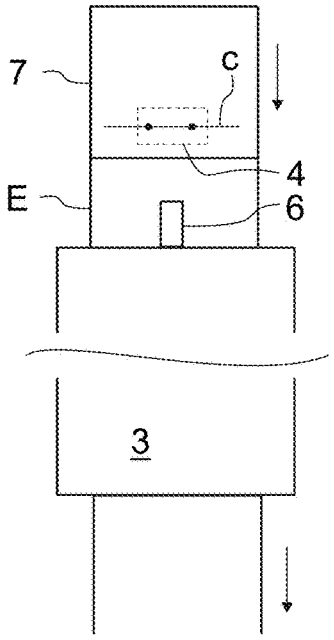
FIG. 3 illustrates preferred details for the rope terminal arrangement of FIG. 1 in according to a first type.

FIG. 3 illustrates details of the rope terminal arrangement 1,1' in accordance of a first type. Here, said one of the rope end and a compression member is the rope end, and the other of said rope end and a compression member is one 3 of the compression members 2,3 of the arrangement 1,1'. Thereby, the contact switch 4 is here mounted on the rope end E, and the arrangement 1,1', in particular said compression member 3, is provided with actuating means 6 arranged to move together with said compression member 3 relative to the rope end E and to actuate the contact switch 4 to switch its state when the rope end E moves in its longitudinal direction relative to the compression member 3.

Said actuating means 6 is in the form of a detent. The detent 6 is arranged to move together with said compression member 3 relative to the rope end E and to actuate the contact switch 4 by pressing it to switch its state when the rope end E moves in its longitudinal direction relative to the compression member 3. For this purpose, the detent 6 and the switch 4 are on collision course, i.e. arranged to eventually collide when the rope end E moves in its longitudinal direction relative to the compression member 3. In rope terminal arrangement 1,1' presented in FIG. 3, the contact switch 4 is of a normally closed type (N.C.) whereby switching the contact switch 4 open is arranged to break the circuit c thereby bringing it from conductive state into non-conductive state. The detent 6 is shaped such that a contact face thereof presses the switch 4 such that it opens when they collide. For this purpose the detent is in the illustrated example in the form of a block comprising said contact face. The block forms here a protrusion extending towards the switch 4. The circuit c is shown in FIG. 3 only partially for the sake of clarity. The circuit c is connected with said monitoring means 5. This can be implemented in multiple alternative ways. Preferred examples have been further described in description of FIGS. 7 and 8. It is preferable, that the switch 4 is mounted on the rope end E via a mounting block 7, as illustrated.

Figure 4:
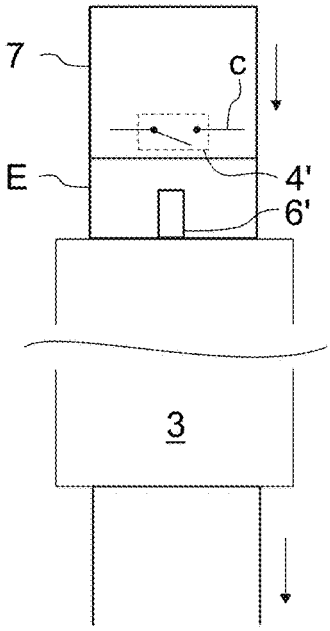
FIG. 4 illustrates preferred details for the rope terminal arrangement of FIG. 1 in according to second type.

FIG. 4 illustrates details of the rope terminal arrangement 1,1' in accordance of a second type. Here, said one of the rope end and a compression member is the rope end, and the other of said rope end and a compression member is one 3 of the compression members 2,3 of the arrangement 1,1'. Thereby, the contact switch 4 is here mounted on the rope end E, and the arrangement 1,1', in particular said compression member 3, is provided with actuating means 6' arranged to move together with said compression member 3 relative to the rope end E and to actuate the contact switch 4' to switch its state when the rope end E moves in its longitudinal direction relative to the compression member 3.

Said actuating means 6' is in the form of a detent. The detent 6' is arranged to move together with said compression member 3 relative to the rope end E and to actuate the contact switch 4 by pressing it to switch its state when the rope end E moves in its longitudinal direction relative to the compression member 3. For this purpose, the detent 6' and the switch 4' are on collision course, i.e. arranged to eventually collide when the rope end E moves in its longitudinal direction relative to the compression member 3. In rope terminal arrangement 1,1' presented in FIG. 4, the contact switch 4' is of a normally open type (N.O.) whereby switching the contact switch 4' closed is arranged to close the circuit c thereby bringing it from non-conductive state into conductive state. The detent 6' is shaped such that a contact face thereof presses the switch 4' such that it closes when they collide. For this purpose the detent is in the illustrated example in the form of a block comprising said contact face. The block forms here a protrusion extending towards the switch 4'. The circuit c is shown in FIG. 4 only partially for the sake of clarity. The circuit c is connected with said monitoring means 5. This can be implemented in multiple alternative ways. Preferred examples have been further described in description of FIGS. 7 and 8. It is preferable, that the switch 4' is mounted on the rope end E via a mounting block 7, as illustrated.

Figure 5:
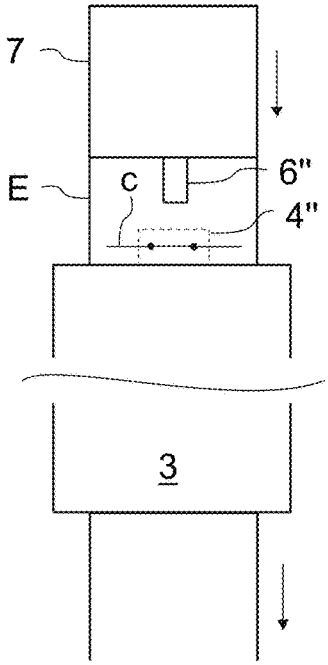
FIG. 5 illustrates preferred details for the rope terminal arrangement of FIG. 1 in according to third type.

FIG. 5 illustrates details of the rope terminal arrangement 1,1' in accordance of a third type. Here, said one of the rope end and a compression member is one 3 of the compression members 2,3 of the arrangement 1,1' and the other of said rope end and a compression member is the rope end E. Thereby, the contact switch 4" is here mounted a compression member 3, and the arrangement, in particular said rope end E is provided with actuating means 6" arranged to move together with the rope end E relative to said compression member 3 and to actuate the contact switch 4" to switch its state when the rope end (E) moves in its longitudinal direction relative to the compression member 3.

Said actuating means 6" is in the form of a detent. The detent 6" is arranged to move together with said compression member 3 relative to the rope end E and to actuate the contact switch 4" by pressing it to switch its state when the rope end E moves in its longitudinal direction relative to the compression member 3. For this purpose, the detent 6" and the switch 4" are on collision course, i.e. arranged to eventually collide when the rope end E moves in its longitudinal direction relative to the compression member 3. In rope terminal arrangement 1,1' presented in FIG. 5, the contact switch 4" is of a normally closed type (N.C.) whereby switching the contact switch 4" open is arranged to break the circuit c thereby bringing it from conductive state into non-conductive state. The detent 6" is shaped such that a contact face thereof presses the switch 4 such that it closes when they collide. For this purpose the detent is in the illustrated example in the form of a block comprising said contact face. The block forms here a protrusion extending towards the switch 4". The circuit c is shown in FIG. 5 only partially for the sake of clarity. The circuit c is connected with said monitoring means 5. This can be implemented in multiple alternative ways. Preferred examples have been further described in description of FIGS. 7 and 8. It is preferable, that the actuating means 6" are mounted on the rope end E via a mounting block 7, as illustrated. The actuating means 6" are illustrated as a part fixed on the mounting block 7, but they may alternatively form an integral part of the mounting block 7.

Figure 6:
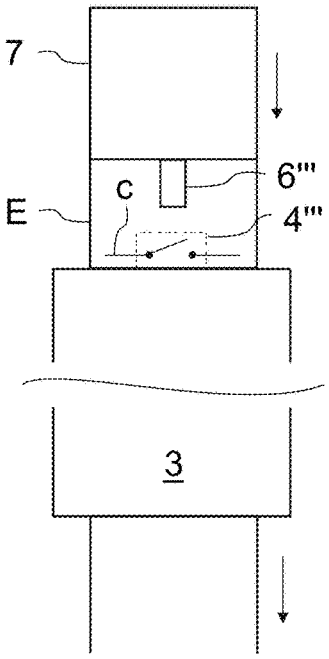
FIG. 6 illustrates preferred details for the rope terminal arrangement of FIG. 1 in according to fourth type.

FIG. 6 illustrates details of the rope terminal arrangement 1,1' in accordance of a fourth type. Here, said one of the rope end and a compression member is one 3 of the compression members 2,3 of the arrangement 1,1' and the other of said rope end and a compression member is the rope end E. Thereby, the contact switch 4" is here mounted a compression member 3, and the arrangement, in particular said rope end E is provided with actuating means 6" arranged to move together with the rope end E relative to said compression member 3 and to actuate the contact switch 4'" to switch its state when the rope end E moves in its longitudinal direction relative to the compression member 3.

Said actuating means 6'" is in the form of a detent. The detent 6'" is arranged to move together with said compression member 3 relative to the rope end E and to actuate the contact switch 4'" by pressing it to switch its state when the rope end E moves in its longitudinal direction relative to the compression member 3. For this purpose, the detent 6'" and the switch 4'" are on collision course, i.e. arranged to eventually collide when the rope end E moves in its longitudinal direction relative to the compression member 3. In rope terminal arrangement 1,1' presented in FIG. 6, the contact switch 4'" is of a normally open type (N.O.) whereby switching the contact switch 4'" closed is arranged to close the circuit c thereby bringing it from non-conductive state into conductive state. The detent 6'" is shaped such that a contact face thereof presses the switch 4'" such that it closes when they collide. For this purpose the detent is in the illustrated example in the form of a block comprising said contact face. The block forms here a protrusion extending towards the switch 4'". The circuit c is shown in FIG. 6 only partially for the sake of clarity. The circuit c is connected with said monitoring means 5. This can be implemented in multiple alternative ways. Preferred examples have been further described in description of FIGS. 7 and 8. It is preferable, that the actuating means 6'" are mounted on the rope end E via a mounting block 7, as illustrated. The actuating means 6" are illustrated as a part fixed on the mounting block 7, but they may alternatively form an integral part of the mounting block 7.

Referring back to FIGS. 1 and 2, the rope terminal arrangement 1,1' is preferably configured to apply the compression with said compression means by wedging of the compression members. As illustrated in FIGS. 1 and 2, the rope terminal arrangement 1,1' comprises a housing (h) on which the compression members 2,3 are mounted. The housing is fixed to a fixing base 50,60,70, such as to an elevator car 50 or to a counterweight 60 or to a stationary structure 70 of a building. The aforementioned wedging is preferably implemented such that the compression members 2,3 are wedge members, and the housing h of the terminal arrangement 1,1' comprises a tapering nest accommodating the compression members 2,3 in the form of wedge members. The nest walls can define a wedge surface for each compression member 2,3. The compression members 2,3 in the form of wedge members are movable relative to each other such that the gap (G) is narrowed by wedging of the compression members 2,3 in the tapering nest, in particular against the wedge surfaces of the housing (h) when moved along the wedge surface of the housing (h) towards the narrower end of the tapering nest. Preferably, the contact faces 12,13 of the compression members 2,3 are arranged to be in contact with and apply compression to substantially the whole width of the rope R. Thereby, even force distribution and gentleness of the contact is facilitated.

The housing h on which the compression members 2,3 are mounted provides a supporting structure for the compression members 2,3 affecting the rope R. For mounting the housing h immovably on a fixing base, it comprises a fixing means 9. In the embodiment illustrated in FIGS. 1 and 2, said fixing means 9 is a fixing bolt, but could alternatively be in some other form.

Preferably, the contact faces 12,13 are straight as viewed in longitudinal direction of the rope end E. Likewise, the section of the rope end E placed between them is also straight, i.e. not bent into an arc. Thus, the rope terminal arrangement 1,1' is well suitable for a hoisting rope that is rigid, and needs to be fixed by a rope terminal arrangement without bending. Thus, it is particularly well suitable for a rope where the load bearing member(s) is/are made of composite material, such as defined above. Composite material of this kind is typically rigid in all directions and thereby also difficult to bend. Rigid ropes being difficult to bend without fracturing them, they should not be fixed with means requiring sharp bends.

As above mentioned, the circuit c is connected with said monitoring means 5. This can be implemented in several alternative ways, such as those presented in FIG. 7 or 8.

Figure 7:
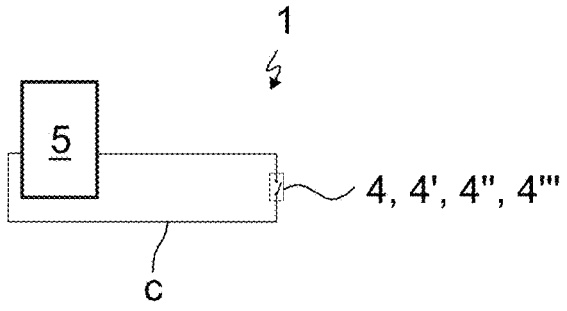
FIGS. 7 and 8 illustrate preferred alternatives for wiring of the rope terminal arrangement.

FIG. 7 illustrates wiring of the rope terminal arrangement 1 according to a first preferred embodiment, wherein the circuit c is connected with said monitoring means 5. In this the rope terminal arrangement 1, the circuit c comprises one switch 4, 4', 4", 4'" provided at an end of a rope and detecting relative movement between the rope end and the compression member compressing the rope. The switch 4, 4', 4", 4'" is arranged to function as earlier described referring to FIGS. 1-6. the rope terminal arrangement 1, the circuit c could further comprise a second switch 4, 4', 4", 4'" provided at a rope end of a second rope, and detecting relative movement between the rope end of the second rope and the compression member compressing the rope end in question. Thus, the same circuit c could be used to monitor movement of more than one rope end in its rope gap. In this case, the electrically conductive lines from the switch 4, 4', 4", 4'", i.e. the electrically conductive lines extending left and right from the switch 4, 4', 4", 4'" as also illustrated in FIGS. 5-6, are connected with said monitoring means 5.

Figure 8:
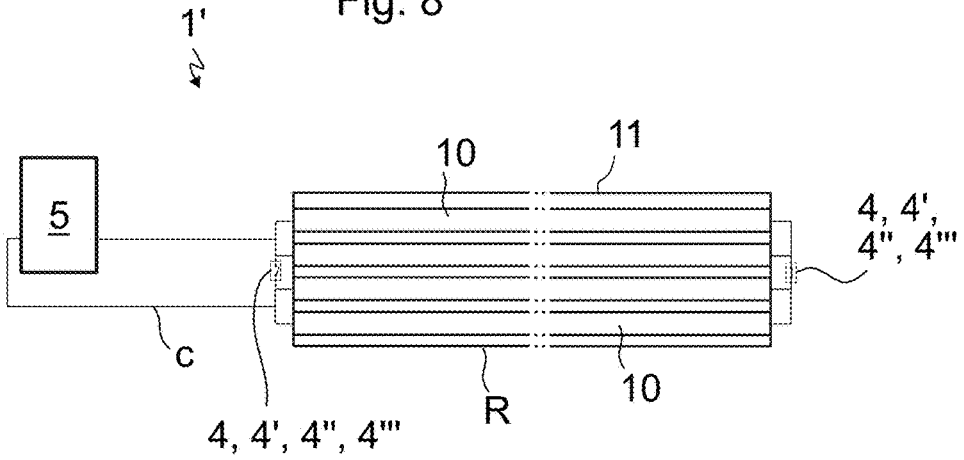

FIG. 8 illustrates wiring of the rope terminal arrangement 1' according to a second preferred embodiment, wherein the circuit c is connected with said monitoring means 5. In this rope terminal arrangement 1', the circuit c comprises one switch 4, 4', 4", 4'" provided at a first rope end of a rope R and detecting relative movement between the rope end and the compression member compressing the rope R. The switch 4, 4', 4", 4'" is arranged to function as earlier described referring to FIGS. 1-6. In this rope terminal arrangement 1', the circuit c further comprises a second switch 4, 4', 4", 4'" provided at a second rope end of the same rope, and detecting relative movement between the second rope end of the rope and the compression member compressing the rope end in question. Thus, the same circuit c is arranged to monitor movement of both rope ends of the rope in its rope gap. In the illustrated embodiment, the load bearing members 10 of the rope R form part of the circuit c. Thus, the contact switches located at opposite rope ends can form part of the same circuit without a separate long wiring connecting them. In the presented embodiment, the electrically conductive lines from the switch 4, 4', 4", 4'", i.e. the electrically conductive lines extending left and right from the switch 4, 4', 4", 4'" as also illustrated in FIGS. 5-6, are connected with said monitoring means 5.

Figure 9:
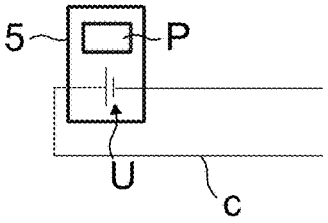
FIG. 9 illustrates a preferred configuration for the monitoring means

Said monitoring means 5 are preferably arranged to monitor the state of the circuit by monitoring conductivity of the circuit c. This can be implemented by any known, for example, such as by means for monitoring one or more electrical properties dependent on conductivity of the circuit c of the circuit, such as voltage over it, resistance thereof or current of the circuit c. FIG. 9 illustrates a preferred configuration for the monitoring means 5. The monitoring means comprises here one or more processors p arranged to monitor state of the circuit c, e.g. by monitoring conductivity of the circuit c as mentioned. The monitoring means 5 further comprise a source of electricity U for electrifying the circuit c. The source of electricity U can be a battery, whereby supply can be ensured, but it can alternatively be any other source of AC or DC.

Figure 10:
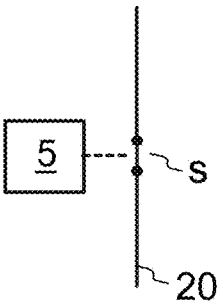
FIG. 10 illustrates a preferred configuration for triggering actions in response to state change of the circuit.
Figure 11:
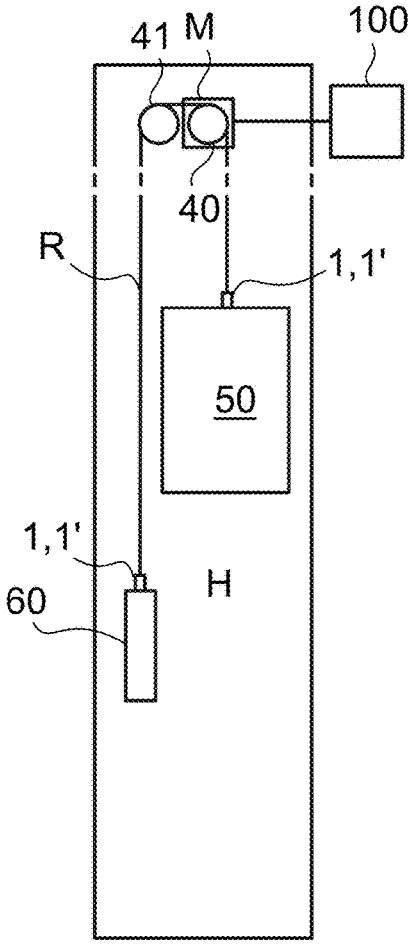
FIGS. 11 and 12 each illustrate an elevator implementing the rope terminal arrangement of FIG. 1.
Figure 12:
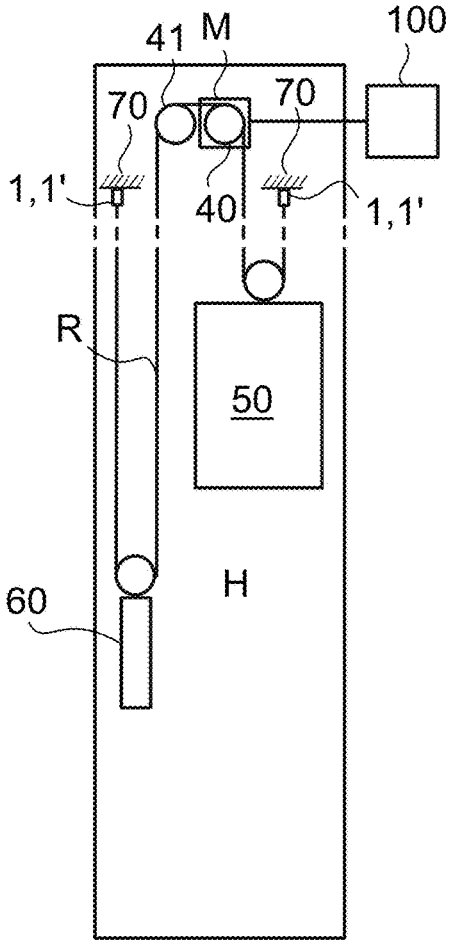

For triggering said one or more actions in response to state change of the circuit s, said monitoring means 5 can be connected with a control unit 100 of the elevator, such as a control unit 100 illustrated in FIGS. 11 and 12, which control unit 100 performs said one or more actions or at least part of them. Triggering an alarm, inter alia, is preferable to be triggered via a control unit 100. Additionally or alternatively, said monitoring means 5 can be configured to operate, in particular to open, a safety switch s of a safety chain 20 (a.k.a. safety circuit) of the elevator in response to said state change, opening of which safety switch s interrupts supply of electricity to the electric motor M of the elevator and/or interrupts supply of electricity to a holding means of a machine brake (not shown) of the elevator. This kind of configuration is illustrated in FIG. 10. The holding means can be of the type that hold (when energized) the machine brake in a non-braking state against spring force of an actuating means such as a spring. The machine brake is a brake acting on a component rotatable together with a drive wheel 40 of the elevator, as illustrated in FIGS. 11 and 12.

FIGS. 11 and 12 illustrate preferred embodiments of the elevator. The elevator comprises a hoistway H and elevator units 50,60 vertically movable in the hoistway H. The elevator units 50,60 include in this case an elevator car 50 and a counterweight 60. In both cases, the elevator further comprises one or more ropes R, each being connected with said elevator units 50, 60 and having two ends, each end being fixed immovably to a fixing base 50,60,70. Each said rope R suspends the elevator units 50,60 whereto it is connected. Accordingly, the rope R is in this case a suspension rope R of the elevator. Said elevators differ from each other in terms of their suspension ratios, i.e. how the ropes have been connected with the elevator units. In the embodiment of FIG. 11, the fixing base is for one end of the rope R the elevator unit 50 and for the other end the elevator unit 60. In the embodiment of FIG. 12, on the other hand, the fixing base is for both ends of the rope R a stationary structure 70 of the building wherein the elevator is installed. The elevator further comprises a rope terminal arrangement 1,1' provided on each of said ends fixing the end in question immovably to its fixing base 50,60,70. The rope terminal arrangement 1,1' is as described elsewhere in the application.

The elevator illustrated in each of FIGS. 11 and 12 is more specifically such that it comprises one or more upper rope wheels 40,41 mounted higher than the car 50 and the counterweight 60, in this case particularly in proximity of the upper end of the hoistway H. In this case there are two of said rope wheels 40,41 but the elevator could be implemented also with some other number of rope wheels. Each of said one or more hoisting ropes R pass around said one or more rope wheels 40,41 mounted in proximity of the upper end of the hoistway H. In this case the one or more rope wheels 40,41 are mounted inside the upper end of the hoistway, but alternatively they could be mounted inside a space beside or above the upper end of the hoistway H. Said one or more rope wheels 40,41 comprise a drive wheel 40 engaging said one or more hoisting ropes R and the elevator comprises a motor M for rotating the drive wheel 40. The elevator car 50 can be moved by rotating the drive wheel 40 engaging the rope(s) R. The elevator further comprises an elevator control unit 100 for automatically controlling rotation of the motor M, whereby the movement of the car 50 is also made automatically controllable.

Each of said one or more hoisting ropes R is belt-shaped and passes around the one or more rope wheels 40,41 the wide side thereof, i.e. the side facing in thickness direction t of the rope R, resting against the rope wheel 40,41. Each hoisting rope passes around the one or more rope wheels 40,41 turning around an axis extending in width direction w of the hoisting rope R.

As mentioned, the belt-shaped rope R preferably has an elastic coating 11 forming the outer surface of the rope R. With the elastic coating, the rope is provided with a surface via which the rope can effectively engage frictionally with a drive wheel, for instance. Thus, it is also possible to provide the load bearing members 10 with protection as well as friction properties adjustable to perform well in the intended use, for instance in terms of traction.

The coating 11 forming the outer surface of the rope R is preferably made of elastic material, such as polyurethane. Elastic material, and particularly polyurethane provides the rope R good frictional properties and wear resistance. Polyurethane is in general well suitable for elevator use, but also materials such as rubber or equivalent elastic materials are suitable for the material of the coating. Preferred structure of the rope R is further described referring to FIGS. 13-14*b*.

Figure 13:
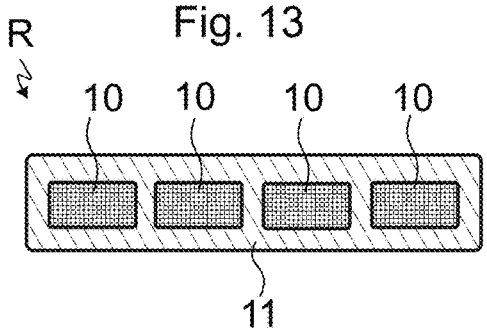
FIG. 13 illustrates a preferred cross section for the rope.

FIG. 13 illustrates a preferred structure for the rope R. As mentioned, the rope R has an elastic coating 11 forming the outer surface of the rope R, and the rope R comprises one or more load bearing members 10 embedded in said elastic coating 11. Each load bearing member 10 extends parallel to the longitudinal direction of the rope R unbroken throughout the length of the rope R. In the presented case, the rope has four load bearing members 10 but the rope R could alternatively have any other number of load bearing members 10.

As mentioned, the rope R is belt-shaped, whereby it is larger in its width direction w than in its thickness direction t. As a result, it has opposing wide sides each being contacted by one of said contact faces 12,13. The width/thickness ratio of the rope R is preferably at least 2 more preferably at least 4, or even more. In this way a large cross-sectional area for the rope is achieved, the bending capacity around the width-directional axis being good also with rigid materials of the load bearing member. Thereby the rope suits very well to be used in hoisting appliances, in particular in elevators, wherein the rope R needs to be guided around rope wheels. Also, it is preferable that the load bearing members are wide. Accordingly, each of said one or more load bearing members 10 is preferably larger in its width direction w than in its thickness direction t. Particularly, the width/thickness ratio of each of said one or more load bearing members is preferably more than 2. Thereby, the bending resistance of the rope is small but the load bearing total cross sectional area is vast with minimal non-bearing areas.

Said one or more load bearing members 10 is/are preferably, but not necessarily, made of composite material comprising reinforcing fibers f embedded in polymer matrix m, said reinforcing fibers preferably being carbon fibers. With this kind of structure, the rope R is rigid against bending. Therefore, it is particularly advantageous that the rope R is fixed by means that do not cause sharp bendings thereto. In many ways, gentleness of the fixing is preferable so as to avoid damaging the load bearing members. In particular, it is preferable that the fixing is implemented by exerting an even force distribution on large surface of the rope, e.g. instead of screws which are likely to damage brittle load bearing members.

Figure 14A:
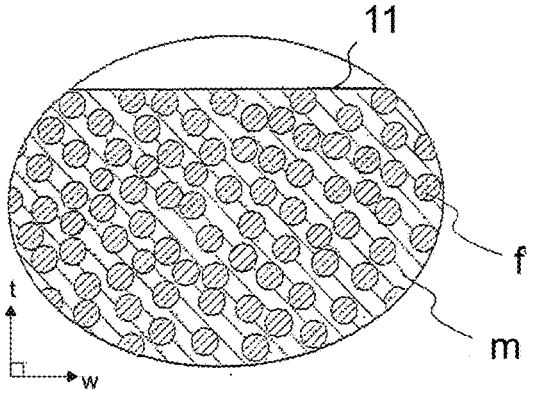
FIG. 14*a* illustrates preferred partially a cross section of a load bearing member of the rope as viewed in longitudinal direction of load bearing member and the rope.
Figure 14B:
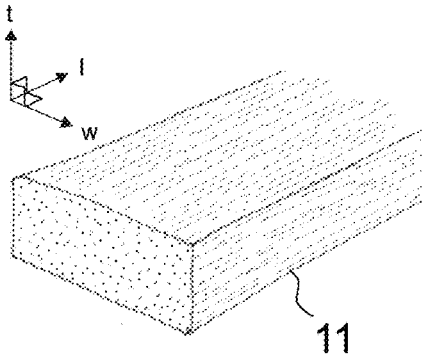
FIG. 14*b* illustrates three-dimensionally a load bearing member of the rope.

FIG. 14*a* illustrates a preferred inner structure for said load bearing member 10, showing inside the circle the cross section of the load bearing member 10 close to the surface thereof, as viewed in the longitudinal direction l of the load bearing member 10. The parts of the load bearing member 10 not showed in FIG. 14*a* have a similar structure. FIG. 14*b* illustrates the load bearing member 10 three dimensionally. The load bearing member 10 is made of composite material comprising reinforcing fibers f embedded in polymer matrix m. The reinforcing fibers f are more specifically distributed substantially evenly in polymer matrix m and bound to each other by the polymer matrix. The load bearing member 10 formed is a solid elongated rod-like one-piece structure. Said reinforcing fibers f are most preferably carbon fibers, but alternatively they can be glass fibers, or possibly some other fibers. Preferably, substantially all the reinforcing fibers f of each load bearing member 10 are parallel with the longitudinal direction of the load bearing member 10. Thereby, the fibers f are also parallel with the longitudinal direction of the rope R as each load bearing member 10 is oriented parallel with the longitudinal direction of the rope R. This is advantageous for the rigidity as well as behavior in bending. Owing to the parallel structure, the fibers in the rope R will be aligned with the force when the rope R is pulled, which ensures that the structure provides high tensile stiffness. The fibers f used in the preferred embodiments are accordingly substantially untwisted in relation to each other, which provides them said orientation parallel with the longitudinal direction of the rope R. This is in contrast to the conventionally twisted elevator ropes, where the wires or fibers are strongly twisted and have normally a twisting angle from 15 up to 40 degrees, the fiber/wire bundles of these conventionally twisted elevator ropes thereby having the potential for transforming towards a straighter configuration under tension, which provides these ropes a high elongation under tension as well as leads to an unintegral structure. The reinforcing fibers f are preferably long continuous fibers in the longitudinal direction of the load bearing member 10, preferably continuing for the whole length of the load bearing member 10.

As mentioned, the reinforcing fibers f are preferably distributed in the aforementioned load bearing member 10 substantially evenly. The fibers f are arranged as evenly as possible, so that the load bearing member 10 would be as homogeneous as possible in the transverse direction thereof. An advantage of the structure presented is that the matrix m surrounding the reinforcing fibers f keeps the interpositioning of the reinforcing fibers f substantially unchanged. It equalizes with its slight elasticity the distribution of force exerted on the fibers, reduces fiber-fiber contacts and internal wear of the rope, thus improving the service life of the rope R. Owing to the even distribution, the fiber density in the cross-section of the load bearing member 10 is substantially constant. The composite matrix m, into which the individual fibers f are distributed, is most preferably made of epoxy, which has good adhesiveness to the reinforcement fibers f and which is known to behave advantageously with reinforcing fibers such as carbon fiber particularly. Alternatively, e.g. polyester or vinyl ester can be used, but any other suitable alternative materials can be used.

The matrix m has been applied on the fibers f such that a chemical bond exists between each individual reinforcing fiber f and the matrix m. Thereby a uniform structure is achieved. To improve the chemical adhesion of the reinforcing fiber to the matrix m, in particular to strengthen the chemical bond between the reinforcing fiber f and the matrix m, each fiber can have a thin coating, e.g. a primer (not presented) on the actual fiber structure between the reinforcing fiber structure and the polymer matrix m. However, this kind of thin coating is not necessary. The properties of the polymer matrix m can also be optimized as it is common in polymer technology. For example, the matrix m can comprise a base polymer material (e.g. epoxy) as well as additives, which fine-tune the properties of the base polymer such that the properties of the matrix are optimized. The polymer matrix m is preferably of a hard non-elastomer, such as said epoxy, as in this case a risk of buckling can be reduced for instance. However, the polymer matrix need not be non-elastomer necessarily, e.g. if the downsides of this kind of material are deemed acceptable or irrelevant for the intended use. In that case, the polymer matrix m can be made of elastomer material such as polyurethane or rubber for instance.

The reinforcing fibers f being in the polymer matrix means here that the individual reinforcing fibers f are bound to each other with a polymer matrix m, e.g. in the manufacturing phase by immersing them together in the fluid material of the polymer matrix which is thereafter solidified.

The reinforcing fibers f together with the matrix m form a uniform load bearing member, inside which no substantial abrasive relative movement occurs when the rope is bent. The individual reinforcing fibers f of the load bearing member 10 are mainly surrounded with polymer matrix m, but random fiber-fiber contacts can occur because controlling the position of the fibers in relation to each other in their simultaneous impregnation with polymer is difficult, and on the other hand, perfect elimination of random fiber-fiber contacts is not necessary from the viewpoint of the functioning of the solution. If, however, it is desired to reduce their random occurrence, the individual reinforcing fibers f can be pre-coated with material of the matrix m such that a coating of polymer material of said matrix is around each of them already before they are brought and bound together with the matrix material, e.g. before they are immersed in the fluid matrix material.

As above mentioned, the matrix m of the load bearing member 10 is most preferably hard in its material properties. A hard matrix m helps to support the reinforcing fibers f, especially when the rope bends, preventing buckling of the reinforcing fibers f of the bent rope, because the hard material supports the fibers f efficiently. To reduce the buckling and to facilitate a small bending radius of the load bearing member 10, among other things, it is therefore preferred that the polymer matrix m is hard, and in particular non-elastomeric. The most preferred materials for the matrix are epoxy resin, polyester, phenolic plastic or vinyl ester. The polymer matrix m is preferably so hard that its module of elasticity (E) is over 2 GPa, most preferably over 2.5 GPa. In this case the module of elasticity E is preferably in the range 2.5-10 GPa, most preferably in the range 2.5-4.5 GPa. There are commercially available various material alternatives for the matrix m which can provide these material properties. Preferably over 50% proportion of the surface area of the cross-section of the load bearing member 10 is of the aforementioned reinforcing fiber, preferably such that 50%-80% proportion is of the aforementioned reinforcing fiber, more preferably such that 55%-70% proportion is of the aforementioned reinforcing fiber, and substantially all the remaining surface area is of polymer matrix m. Most preferably, this is carried out such that approx. 60% of the surface area is of reinforcing fiber and approx. 40% is of matrix material (preferably epoxy material). In this way a good longitudinal stiffness for the load bearing member 10 is achieved. As mentioned carbon fiber is the most preferred fiber to be used as said reinforcing fiber due to its excellent properties in hoisting appliances, particularly in elevators. However, this is not necessary as alternative fibers could be used, such as glass fiber, which has been found to be suitable for the hoisting ropes as well. Carbon fiber is, however preferable, when the load bearing member 10 is intended to form part of the circuit c, because carbon fibers are electrically conductive.

In the illustrated embodiments, the load bearing members 10 are substantially rectangular and larger in width direction than thickness direction. However, this is not necessary as alternative shapes could be used. Likewise, it is not necessary that the number of the load bearing members is four which is used for the purpose of the example. The number of the load bearing members 10 can be greater or smaller. The number can be one, two or three for instance, in which cases it may be preferably to shape it/them wider than what is shown in Figures.

The rope R is furthermore such that the aforementioned load bearing member 10 or a plurality of load bearing members 4, comprised in the rope R, together cover majority, preferably 70% or over, more preferably 75% or over, most preferably 80% or over, most preferably 85% or over, of the width of the cross-section of the rope R for essentially the whole length of the rope R. Thus the supporting capacity of the rope R with respect to its total lateral dimensions is good, and the rope R does not need to be formed to be thick.

Figure 15:
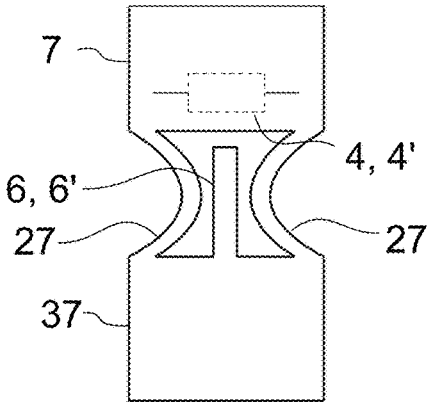
FIG. 15 illustrates a preferred embodiment of the rope terminal arrangement in accordance with FIG. 3 or 4.

FIG. 15 illustrates preferred further details for the rope terminal arrangement 1,1' when in accordance with the first or second embodiment presented in FIGS. 3 and 4. The rope terminal arrangement 1,1' comprises here a mounting block 7 mounted on the rope end E (not shown), the contact switch 4,4' being mounted on the mounting block 7. Thereby, the contact switch 4,4' is mounted on the rope end E via the mounting block 7. The mounting block 7 is connected with elastic means (elastic members 27) with the actuating means 6,6' in the form of a detent arranged to move together with a compression member 3 (not shown) relative to said one of said rope end when the rope end moves in its longitudinal direction relative to the compression member 3. The actuating means 6,6' are preferably mounted on the compression member 3, and thereby arranged to move as defined, i.e. together with the compression member 3 relative to said one of said rope end when the rope end moves in its longitudinal direction relative to the compression member 3. However, this is not necessary as alternatively the actuating means 6,6' can be placed apart of the compression member 3 such that they are in collision course with the compression member 3, whereby after collision the defined relative movement occurs. This is possible as the actuating means 6,6' are in this embodiment carried by the mounting block 7. In this embodiment, the mounting block 7, the elastic means 27 and the actuating means 6,6' are integral with each other, preferably molded from plastic as one-piece structure.

In general, it is preferable that the contact switch 4, 4', 4", 4'" is mounted immovably on said one of the rope end and a compression member. Thereby, the relative movement needed for causing actuation can be adjusted short. It is however not necessary that the contact switch is mounted immovably as it could be mounted alternatively movably with a limited range of movability, such as by mounting it via an elastic mounting means. Said actuating means are preferably immovable relative to said other of said rope end and a compression member, preferably either mounted immovably thereon or forming an integral part thereof. Thereby, the relative movement needed for causing actuation can be adjusted short. It is however not necessary that the contact switch is mounted immovably as it could be mounted alternatively movably with a limited range of movability, such as by mounting it via an elastic mounting means.

In the preferred embodiments presented, the elevator is a counterweighted elevator. However, the rope terminal arrangement 1,1' can be likewise utilized in a counterweightless elevator.

In the preferred embodiments presented in the FIGS. 11 and 12, both ends of the rope R have been fixed to similar type of a fixing base. However, the elevator could alternatively be such that one end of the rope is fixed to a one of the movable elevator units 50,60 and the other end to the stationary structure 70 of the building, which would be the case if the suspension ratios need to be set different on opposite sides of the drive wheel 40, for instance.

In the preferred embodiments, the advantageous structure for the rope R has been disclosed. However, the invention can be utilized with also other kind of ropes such as belt-shaped ropes having different materials. In the preferred embodiments presented in the Figures, the rope R is a flat rope having planar wide sides. However, the rope could alternatively be contoured to have some other shape, such as a polyvee-shape, for example.

Generally, the rope end E is placed in the rope gap G such that it is under tension on one side of the gap G in longitudinal direction of the rope. On this side, the rope extends away from the fixing base, such as to a load of the elevator suspended by the rope R. On the opposite side, a stump of the rope end E protrudes from the gap G. On this opposite side, the rope end E, i.e. the stump thereof, may be substantially untensioned. When referring to movement of the rope end E in its longitudinal direction relative to the compression member 3, it is meant in particular movement directed outwards from the gap G towards the tensioned side.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. A rope terminal arrangement of an elevator, comprising two compression members delimiting a rope gap between them, the compression members being arranged to compress a rope end of a belt-shaped rope placed in the rope gap for blocking movement of the rope end in its longitudinal direction relative to the compression members;

an electrical circuit comprising a contact switch, which is switchable between a first and second state, in particular between open and closed state;

the contact switch being mounted on one of the rope end and a compression member, and the arrangement, in particular said other of said rope end and a compression member, is provided with an actuator arranged to move together with the other of said rope end and a compression member relative to said one of said rope end and a compression member and to actuate the contact switch to switch its state when the rope end moves in its longitudinal direction relative to the compression member, whereby movement of the rope end in its longitudinal direction relative to the compression member is arranged to cause state change of the electrical circuit; and a monitor arranged to monitor state of the circuit and to trigger one or more actions in response to state change of the circuit.

2. A rope terminal arrangement according to claim 1, wherein the elevator comprises an elevator car and said one or more actions include stopping the movement of the elevator car.

3. A rope terminal arrangement according to claim 1, wherein said one or more actions include generating an alarm.

4. A rope terminal arrangement according to claim 1, wherein elevator comprises an elevator car and said one or more actions include obstructing further runs of the elevator car.

5. An elevator according to claim 1, wherein said other of said rope end and a compression member is provided with said actuator.

6. An elevator according to claim 1, wherein the contact switch is mounted immovably on said one of the rope end and a compression member, and said actuator is immovable relative to said other of said rope end and a compression member.

7. An elevator according to claim 1, wherein said one of the rope end and a compression member is the rope end, and the other of said rope end and a compression member is a compression member.

8. An elevator according to claim 1, wherein said actuator is in the form of a detent.

9. A rope terminal arrangement according to claim 1, wherein said compression members comprise a first compression member having a first contact face to be pressed against a wide side of the belt-shaped rope; and a second compression member having a second contact face to be pressed against a wide side of the belt-shaped rope; and said compression members are placed such that their contact faces face each other and delimit between them said rope gap.

10. A rope terminal arrangement according to claim 1, wherein the rope has surface made of elastic material, the rope preferably comprising an elastic coating forming the outer surface of the rope.

11. A rope terminal arrangement according to claim 1, wherein said rope comprises one or more load bearing members embedded in an elastic coating forming the outer surface of the rope, which one or more load bearing members extend parallel to the longitudinal direction of the rope unbroken throughout the length of the rope.

12. A rope terminal arrangement according to claim 1, wherein the rope terminal arrangement comprises a housing on which the compression members are mounted, which housing is fixed to a fixing base, such as to an elevator car or to a counterweight or to a stationary structure of a building.

13. A rope terminal arrangement according to claim 1, wherein the compression members are wedge members, and the terminal arrangement comprises a housing comprising a tapering nest accommodating the wedge members, in particular having a wedge surface for each compression member, and the compression members are movable relative to each other such that the rope gap is narrowed by wedging of the compression members in the tapering nest, in particular against the wedge surfaces of the housing when moved along the wedge surface of the housing towards the narrower end of the tapering nest.

14. A rope terminal arrangement according to claim 11, wherein said one or more load bearing members is/are made of composite material comprising reinforcing fibers embedded in polymer matrix, said reinforcing fibers preferably being carbon fibers.

15. A rope terminal arrangement according to claim 11, wherein the rope terminal arrangement comprises compression members as defined at opposite rope ends of the same rope, blocking movement of the rope end in its longitudinal direction relative to the compression members, and the circuit comprises two of said contact switches, a contact switch and actuating means at opposite rope ends of the same rope cooperating as defined, whereby at both ends of the rope movement of the rope end in its longitudinal direction relative to the compression member is arranged to cause state change of the electrical circuit; and the rope comprises load bearing members extending in longitudinal direction of the rope unbroken throughout its length, which load bearing members are made of electrically conductive material, preferably of electrically conductive composite material, the composite material preferably comprising electrically conducting reinforcing fibers embedded in polymer matrix, said reinforcing fibers preferably being carbon fibers, and the one or more of the load bearing members form part of the circuit and the monitor is arranged to monitor state of the circuit and to trigger one or more actions in response to state change of the circuit.

16. An elevator, which comprises a rope terminal arrangement as defined in claim 1 fixing an end of a rope of the elevator immovably to a fixing base.

* * * * *